US005894455A

United States Patent [19]

Sikes

[11] Patent Number: 5,894,455

[45] Date of Patent: Apr. 13, 1999

[54] ALARM CLOCK SYSTEM WITH EAR INSERT

[76] Inventor: Johnnie Aman Sikes, 2401 W. Lowry Ave., Plant City, Fla. 33567

[21] Appl. No.: 08/804,277

[22] Filed: Mar. 3, 1997

[51] Int. Cl.[6] ..... G04B 37/00

[52] U.S. Cl. ..... 368/12

[58] Field of Search ..... 368/12, 230

[56] References Cited

U.S. PATENT DOCUMENTS

| | | | |
|---|---|---|---|
| 2,517,368 | 8/1950 | Wiseley | 161/22 |
| 4,456,387 | 6/1984 | Igarashi | 368/230 |
| 4,473,821 | 9/1984 | Yang et al. | 340/539 |
| 4,531,115 | 7/1985 | Black et al. | 340/539 |
| 4,777,474 | 10/1988 | Clayton | 340/539 |
| 4,821,247 | 4/1989 | Grooms | 368/63 |
| 5,144,600 | 9/1992 | Cheng | 368/12 |
| 5,521,582 | 5/1996 | Kingston | 340/539 |
| 5,686,882 | 11/1997 | Giani | 368/230 |

FOREIGN PATENT DOCUMENTS

| | | | |
|---|---|---|---|
| 53-0017768 | 2/1978 | Japan | 368/12 |

*Primary Examiner*—Bernard Roskoski
*Attorney, Agent, or Firm*—Joseph N. Breaux

[57] ABSTRACT

An alarm clock system including an alarm clock circuit having an alarm output signal; a radio transmitter circuit responsive to the alarm output signal of the alarm clock circuit in a manner to transmit a transmitted alarm signal; and an ear insert including an audible output transducer positioned within an ear insert housing, a radio receiving and alarm generating circuit tuned to receive the transmitted alarm signal and in electrical connection with the audible output transducer, the radio receiving and alarm generating circuit generating a signal to the audible output transducer in response to receipt of the transmitted alarm signal. In one preferred embodiment the radio transmitter is electrically coupled to the alarm clock circuit. In another preferred embodiment the radio transmitter circuit includes an audio pick-up, the alarm clock circuit includes a speaker, and the radio transmitter circuit is coupled to the alarm clock circuit through the speaker and the audio pick-up. When audio coupling is used, it is preferred to provide a mechanism for muting the output of the alarm circuit speaker.

3 Claims, 2 Drawing Sheets

ALARM CLOCK SYSTEM WITH EAR INSERT

TECHNICAL FIELD

The present invention relates to audible alarm devices and more particularly to an alarm clock system includes an alarm clock circuit having a conventional speaker output, a radio transmitter responsive to the conventional alarm clock circuit, and an ear insert having a radio receiver and an audio output, the ear insert being to the alarm clock circuit through a radio link between the radio transmitter and the radio receiver.

BACKGROUND OF THE INVENTION

Many individuals suffer from a hearing loss sufficient to prevent them from hearing a conventional alarm clock wake-up alarm. In addition, many individuals share a bed with a spouse or a room with another person who are awoken or disturbed when an alarm clock sounds a wake-up alarm that is only needed by one of the people. It would be a benefit, therefore, to have an alarm clock system that included an ear insert having an audible output that could be inserted into the ear of the person needing to be awoken. Because on some days all of the people sleeping in the room must be awoken at the same time, it would be a further benefit to have such an alarm clock system that included a convention speaker output for sounding a general wake-up alarm.

SUMMARY OF THE INVENTION

It is thus an object of the invention to provide an alarm clock system that includes an ear insert having an audible output that can be inserted into the ear of the person needing to be awoken.

It is a further object of the invention to provide an alarm clock system that includes a convention speaker output for sounding a general wake-up alarm and an ear insert having an audible output that can be inserted into the ear of the person needing to be awoken when only one person need be awoken.

It is still a further object of the invention to provide an alarm clock system that includes an ear insert having an audible output that can be inserted into the ear of the person needing to be awoken wherein the ear insert is linked to the alarm clock by a radio link.

It is a still further object of the invention to provide an alarm clock system with an ear insert that accomplishes some or all of the above objects in combination.

Accordingly, an alarm clock system with ear insert is provided. The alarm clock system comprises an alarm clock circuit responsive to the alarm output signal; a radio transmitter circuit responsive to the alarm output signal of the alarm clock circuit in a manner to transmit a transmitter alarm signal; and an ear insert including an audible output transducer positioned within an ear insert housing, a radio receiving and alarm generation circuit tuned to receive the transmitted alarm signal and in electrical connection with the audible output transducer, the radio receiving and alarm generating circuit generating a signal to the audible output transducer in response to receipt of the transmitted alarm signal. In one preferred embodiment the radio transmitter is electrically coupled to the alarm clock circuit. In another preferred embodiment the radio transmitter circuit includes an audio pick-up, the alarm clock circuit includes a speaker, and the radio transmitter circuit is coupled to the alarm clock circuit through the speaker and the audio pick-up. When audio coupling is used, it is preferred to provide a mechanism for muting the output of the alarm circuit speaker.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
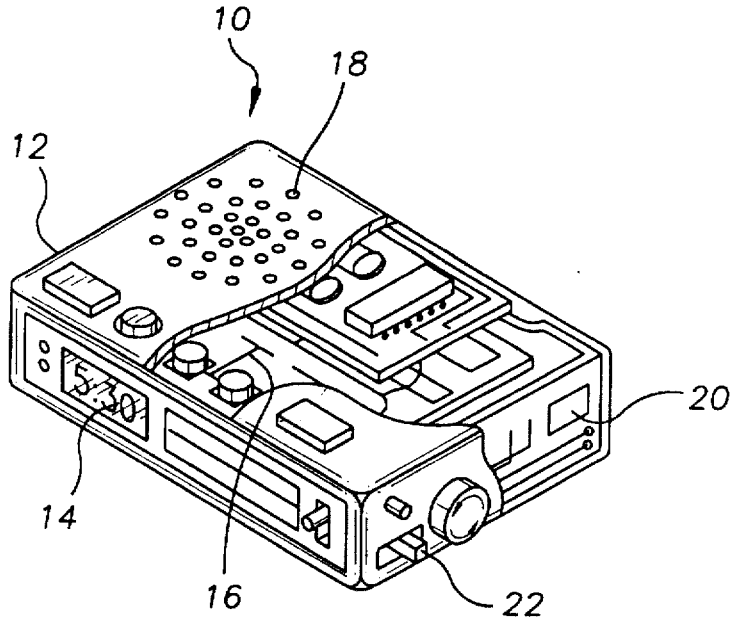
FIG. 1 is a particular cut-away, perspective view of a first exemplary alarm clock circuit of the alarm clock system with ear insert of the present invention showing the alarm clock housing, the clock circuitry, the alarm circuitry, the speaker output, the radio transmitter circuitry, and the mode selector switch.

FIG. 1 shows a first exemplary alarm clock circuit of the alarm clock system with ear insert of the present invention, generally designated by the numeral 10. Alarm clock circuit 10 includes a molded plastic alarm clock housing 12, a conventional clock circuit 14, a conventional alarm circuit 16, a speaker 18, a conventional FM radio transmitter circuit 20, and a slide-type mode selector switch 22. Alarm clock circuit 10 operates in the conventional fashion except that radio transmitter circuit 20 has a control input wired through mode selector switch 22 to alarm, circuit 16 in a manner such that the alarm output signal is routed to speaker 18 when conventional operation is desired and to radio transmitter circuit 20 when ear insert operation is desired. Radio transmitter circuit 20 generates and transmits a transmitted alarm signal over a selected FM frequency between 87.5 MHZ and 107.9 MHZ.

Figure 2:
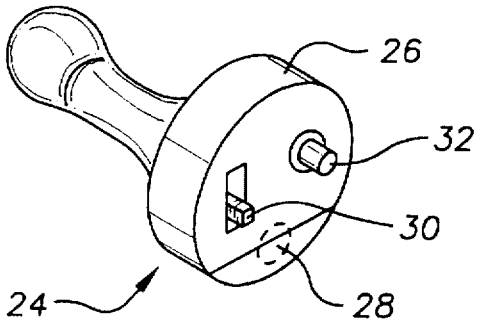
FIG. 2 is a perspective view of an exemplary embodiment of the ear insert of the alarm clock system with ear insert of the present invention showing the insert housing, the battery compartment, the on/off switch, and the volume control.
Figure 3:
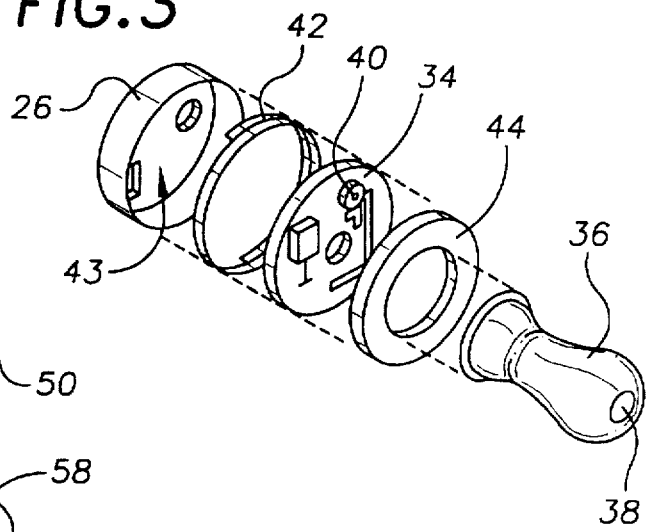
FIG. 3 is an exploded perspective view of the ear insert of FIG. 2 showing the ear insertable speaker housing, the top housing plate, the radio receiver circuitry, the coiled wire antenna, and the lower housing.

With reference to FIG. 2, the alarm clock system with ear insert of the present invention also includes an ear insert 24. Ear insert 24 includes an insert housing 26 forming a battery compartment 28 and housing an on/off switch 30, a volume control 32 and a radio receiving circuit 34 (FIG. 3). With reference to FIG. 3, an ear insertable speaker housing 36 having a speaker 38 provided at the tip end thereof is secured to insert housing 26. Speaker 38 is electrically connected to radio receiving circuit 34. In this embodiment radio receiving circuit 34 is a conventional radio receiving circuit capable of receiving FM transmission between 87.5 MHZ and, 107.9 MHZ. A potentiometer 40 is provided for tuning radio receiving circuit 34 to the transmitted frequency of radio transmitter circuit 20 and a coiled wire antenna 42 is provided for increasing radio reception of radio receiver circuit 34. Radio receiving circuit 34 and coiled wire antenna 42 are housed within a circuit compartment 43 formed within insert housing 26 and held in place by a top housing plate 44. Referring generally now to FIGS. 1–3, in use, clock circuit 10 is set with the correct time and desired alarm time in the conventional fashion. If insert operation is desired, mode selector switch 22 is set to insert mode and insertable speaker housing 36 inserted into the ear of the user prior to retiring. When alarm circuit 10 detects attainment of the alarm time, radio transmitter circuit 20 is activated and generates and transmits a transmitted alarm signal to receiver circuit 34. Receiver circuit 34 in-torn causes speaker 38 to sound awaking the individual wearing ear insert 24 without disturbing others in the room.

Figure 4:
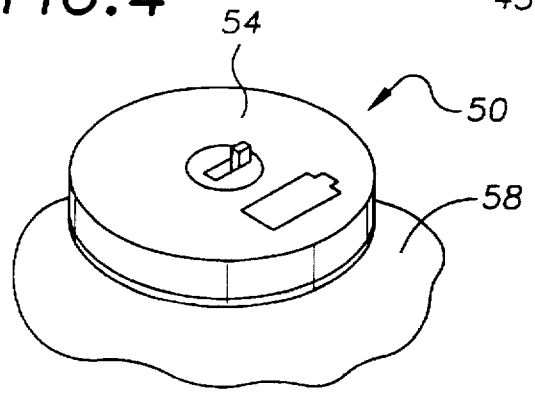
FIG. 4 is a perspective view of a radio transmitter and speaker cover assembly of a second exemplary alarm clock system with ear insert of the present invention showing the sand filled muting and pick-up bag; the radio transmitter circuitry housing, the on/off switch, and the battery compartment.
Figure 5:
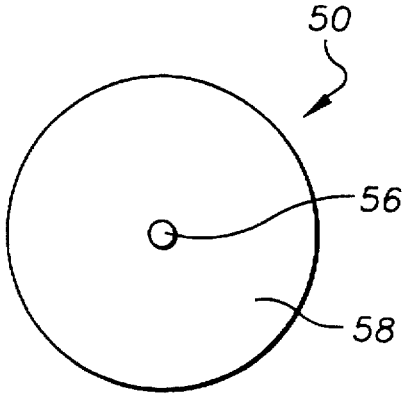
FIG. 5 is a plan view of underside of the radio transmitter and speaker cover assembly of FIG. 4 showing the audio pick-up and the outer surface of the sand filled muting bag.
Figure 6:
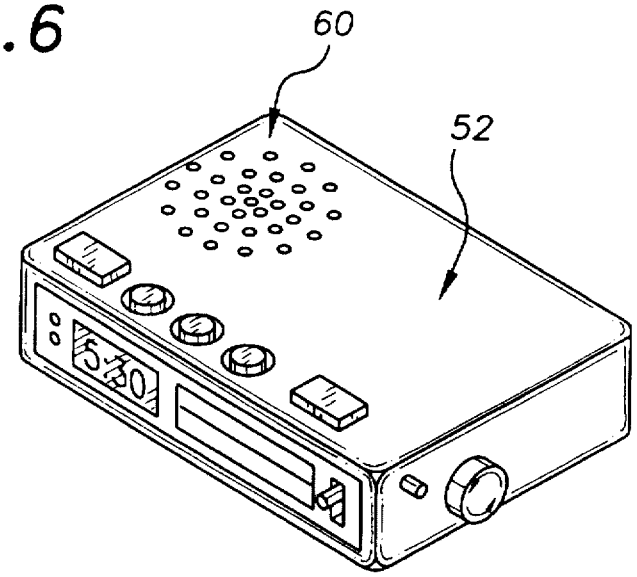
FIG. 6 is a perspective view of a conventional alarm clock having a sneaker output of the type with which the radio transmitter and speaker cover assembly of FIG. 4 is used.
Figure 7:
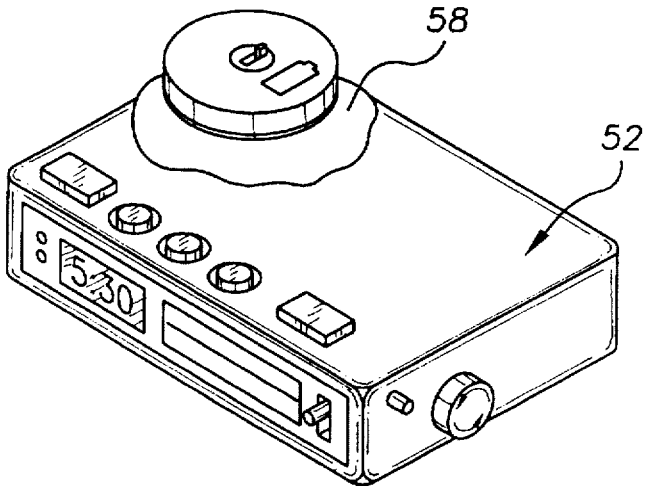
FIG. 7 is a perspective view of the radio transmitter and speaker cover assembly of FIG. 4 positioned over and covering the speaker output of the alarm clock of FIG. 6.

With reference now to FIG. 4, in a second exemplary embodiment, the alarm clock system with ear insert includes a radio transmitter and speaker cover assembly, generally designated by the numeral 50. Radio transmitter and speaker cover 50 is used in conjunction with a conventional alarm clock 52 (FIG. 6) and ear insert 24 (FIG. 2). Radio transmitter and speaker cover 50 includes a plastic radio transmitter circuitry housing 54 containing a conventional radio transmitter circuitry 20 having an audio pick-up 56 (FIG. 5) in triggering connection therewith. The term "triggering connection" is used herein to mean that receipt of an audio signal of sufficient strength, from audio pick-up 56 triggers radio transmitter circuit 20 to generate and transmit a transmitted alarm signal. Radio transmitter and speaker cover 50 also includes a sand filled speaker muting bag 58 constructed of plastic lined woven fabric. With reference to FIG. 5, audio pick-up 56 extends out through a centrally located bottom surface of speaker muting bag 58. With reference to FIG. 7, in use, speaker muting bag 58 is placed over a speaker output 60 (FIG. 6) to prevent sound generated by speaker output 60 from disturbing individuals within the room. After thus positioning speaker muting bag 58, the volume control of alarm clock 52 is adjusted to provide the lowest setting that is sufficient to trigger radio transmitter circuit 20 through audio pick-up 56 (FIG. 5). Insertable speaker housing 36 (FIG. 3) is then inserted into the ear of the user prior to retiring.

It can be seen from the preceeding description that an alarm clock system has been provided that includes an ear insert having an audible output that can be inserted into the ear of the person needing to be awoken; that includes a convention speaker output for sounding a general wake-up alarm and an ear insert having an audible output that can be inserted into the ear of the person needing to be awoken when only one person need be awoken; and that includes an ear insert having an audible output that can be inserted into the ear of the person needing to be awoken wherein the ear insert is linked to the alarm clock by a radio link.

It is noted that the embodiments of the alarm clock system with ear insert described herein in detail for exemplary purposes are of course subject to many different variations in structure, design, application and methodology. Because many varying and different embodiments may be made within the scope of the invention concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An alarm clock system with ear insert comprising:

an alarm clock circuit having an alarm output signal;

a radio transmitter circuit responsive to said alarm output signal of said alarm clock circuit in a manner to transmit a transmitted alarm signal;

an ear insert including an audible output transducer positioned within an ear insert housing, a radio receiving and alarm generating circuit tuned to receive said transmitted alarm signal and in electrical connection with said audible output transducer, said radio receiving and alarm generating circuit generating a signal to said audible output transducer in response to receipt of said transmitted alarm signal; and a muting mechanism in connection with said radio transmitter circuit for muting said output of said alarm circuit speaker;

said radio transmitter circuit including an audio pick-up;

said alarm clock circuit including a speaker;

said radio transmitter circuit being coupled to said alarm clock circuit through said speaker and said audio pick-up;

said muting mechanism having said audio pick-up in connection therewith.

2. The alarm clock system with ear insert of claim 1, wherein:

said muting mechanism includes a sand filled muting bag.

3. The alarm clock system with ear insert of claim 2 wherein:

said sand filled muting bag is constructed from plastic lined woven fabric.

* * * * *